United States Patent [19]

Inoue

[11] 4,262,504

[45] Apr. 21, 1981

[54] LOCKING DEVICE

[75] Inventor: Akihiko Inoue, Soma, Japan

[73] Assignee: Alps Electric Co., Ltd., Tokyo, Japan

[21] Appl. No.: 857,252

[22] Filed: Dec. 5, 1977

[30] Foreign Application Priority Data

Dec. 3, 1976 [JP] Japan ..... 51-145459

[51] Int. Cl.[3] ..... E05B 55/00

[52] U.S. Cl. ..... 70/151 R; 292/144; 292/333

[58] Field of Search ..... 292/144, 166, 168, 174, 292/177, 181, 179, 332, 333, 335, 169.13; 70/151 R

[56] References Cited

U.S. PATENT DOCUMENTS

| | | | |
|---|---|---|---|
| 1,299,195 | 4/1919 | Kohn | 292/333 |
| 3,353,383 | 11/1967 | Fish | 70/151 |
| 3,621,686 | 11/1971 | Klein | 292/335 |
| 4,099,752 | 7/1978 | Geringer | 292/144 |
| 4,132,439 | 1/1979 | Miller | 292/144 |

FOREIGN PATENT DOCUMENTS

| | | | |
|---|---|---|---|
| 541556 | 1/1932 | Fed. Rep. of Germany | 292/333 |

*Primary Examiner*—Robert L. Wolfe

*Attorney, Agent, or Firm*—Guy W. Shoup; Gerard F. Dunne

[57] ABSTRACT

Disclosed is a locking device for locking a door and the like, suitable for use in an electric locking system. The device has a dead bolt which is held in a retracted position within a housing when the door is open, and an actuating member adapted to be partially projected out of the housing when the door is open. The actuating member is slidably mounted in the housing and has an inclined surface acting as a cam surface for engagement with the end surface of the door. The actuating member is so inter-related with the dead bolt that the latter is driven into a corresponding hole in the door jam as the slidable member is depressed by the door, in the course of closing of the door. An electromagnetic plunger is provided for allowing the retraction of the dead bolt in accordance with a predetermined specific electric signal. A manually operative member is associated with the electromagnetic plunger to allow a manual unlocking if necessary.

9 Claims, 8 Drawing Figures

LOCKING DEVICE

BACKGROUND OF THE INVENTION

The present invention relates to a locking device suitable for use in a lock system adapted to be actuated in response to electric signals.

Locking devices which are operable mechanically by the use of keys or by operation of a combination lock mechanism are known, for example, those described in the U.S. Pat. Nos. 3,621,686 and 3,353,383. Such devices, however, are often objectionably complex or are not readily made responsive to actuation by electric signals.

It is an object of the present invention to provide a locking device which can be actuated by electric signals.

It is another object of the present invention to provide a locking device which can be operated manually if necessary.

It is another object of the invention to provide a locking device which can be operated easily.

It is another object of the invention to provide a locking device having a simple construction.

To these ends, according to the invention, there is provided a locking device comprising a bolt adapted to be held at a retracted position in a lock housing when the door is open and an actuating member partially projected out of said lock housing when said door is open. The actuating member is adapted to be depressed into said lock housing to cause the bolt to project out of said lock housing to turn said locking device on. The bolt is further adapted to be retracted into a retracted position by means of an electromagnetic plunger to turn said locking device off. Additionally, the bolt may be retracted manually.

These and other objects, as well as advantageous features of the invention will become clear from the following description of the preferred embodiment taken in conjunction with the attached drawings in which:

DETAILED DESCRIPTION

Hereinafter, a preferred embodiment of the invention will be described with reference to FIGS. 1 to 8.

Figure 1:
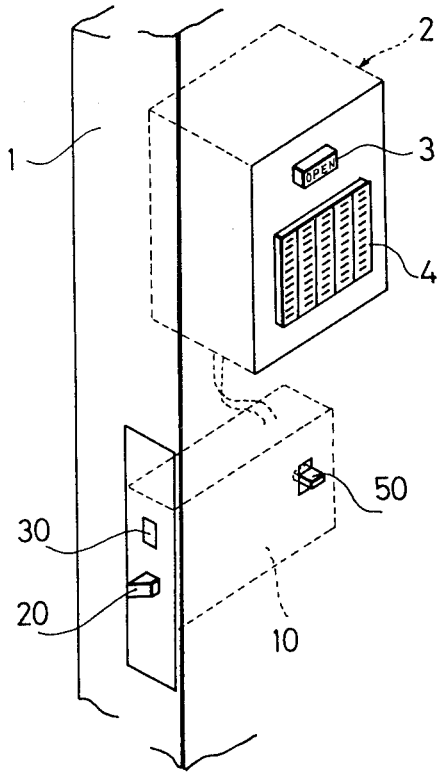
FIG. 1 is an illustration of a locking device embodying the present invention, set in a wall of a house near a door.

Referring at first to FIG. 1, which shows a locking device in the installed condition, a lock housing 10 is embedded in a partition 1 which may be, for example, a wall separating the inside and the outside of a house. A dead bolt 30 and a slidable actuating member 20 are provided for freely getting into and out of the end surface of the wall confronting the end surface of a door, not shown.

Figure 4:
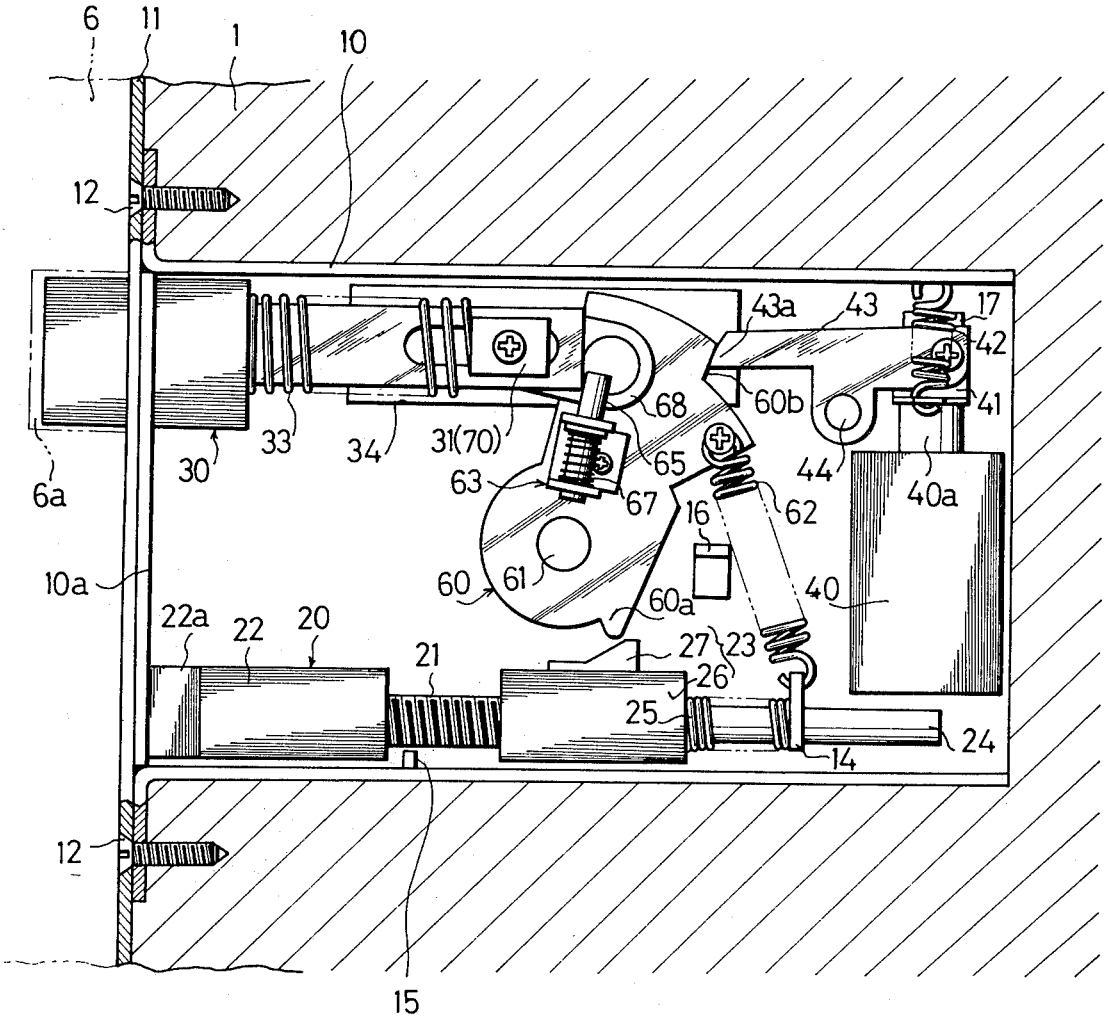

As shown in FIG. 4, the end surface of a door 6 is provided with a hole only at a position corresponding to the dead bolt 30 for receiving the latter. The arrangement is such that the dead bolt is automatically driven into the hole and the actuating member 20 is forced into the lock housing 10 to turn the lock on, as the door is closed.

A control box generally designated at 2 accomodates a control circuit for an electromagnetically actuated plunger 40 housed by the lock housing 10. The control circuit is adapted to control the plunger 40 in such a manner that the plunger operates to release the dead bolt 30 when the button 3, located in the present example at the inside of the house, is depressed. The control box 2 further incorporates a programming plate 4 provided with a group of switches which are adapted to provide digital signals to set a combination of key codes. Although neglected from the drawings, a key board device, or a hole for receiving a magnetic card or punched card, is provided in the control box 2 to appear at the outside of the house. The arrangement is such that the electromagnetic plunger 40 is actuated only when a correct or identified card is inserted into the hole, thereby to allow the door to be opened from the outside. Since the control box does not constitute the essential feature of the invention, no further explanation thereof is made here. Further, a button or lever 50 is provided on the lock housing to project into the inside of the house, for allowing a manual releasing of the lock in case of an emergency, such as a power failure.

The locking device of the present invention is suitable for use in the electric locking system of the described type, as will be seen from the following description developed with reference to FIGS. 2 to 8.

Figure 2:
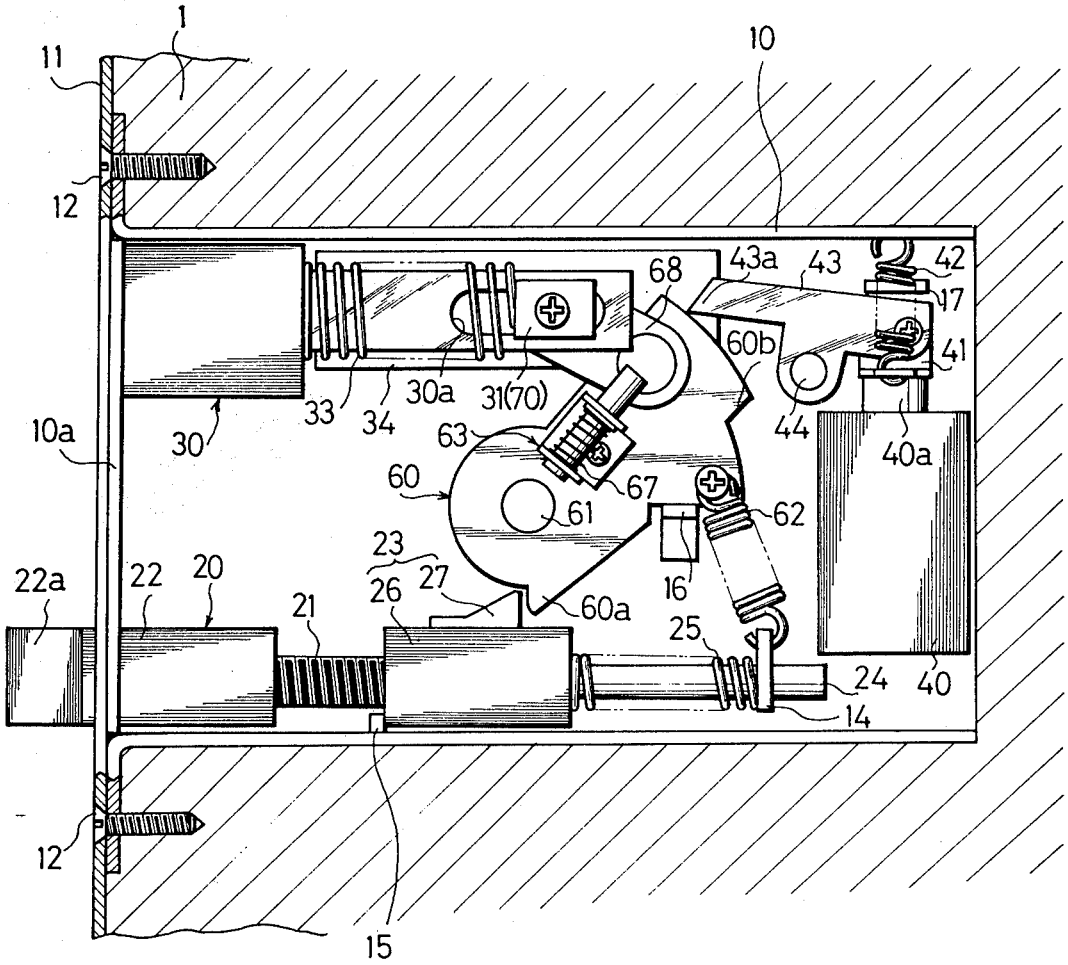
FIGS. 2 to 4 are partially sectioned plan views of the locking device of FIG. 1, for explaining the manner of operation thereof.
Figure 3:
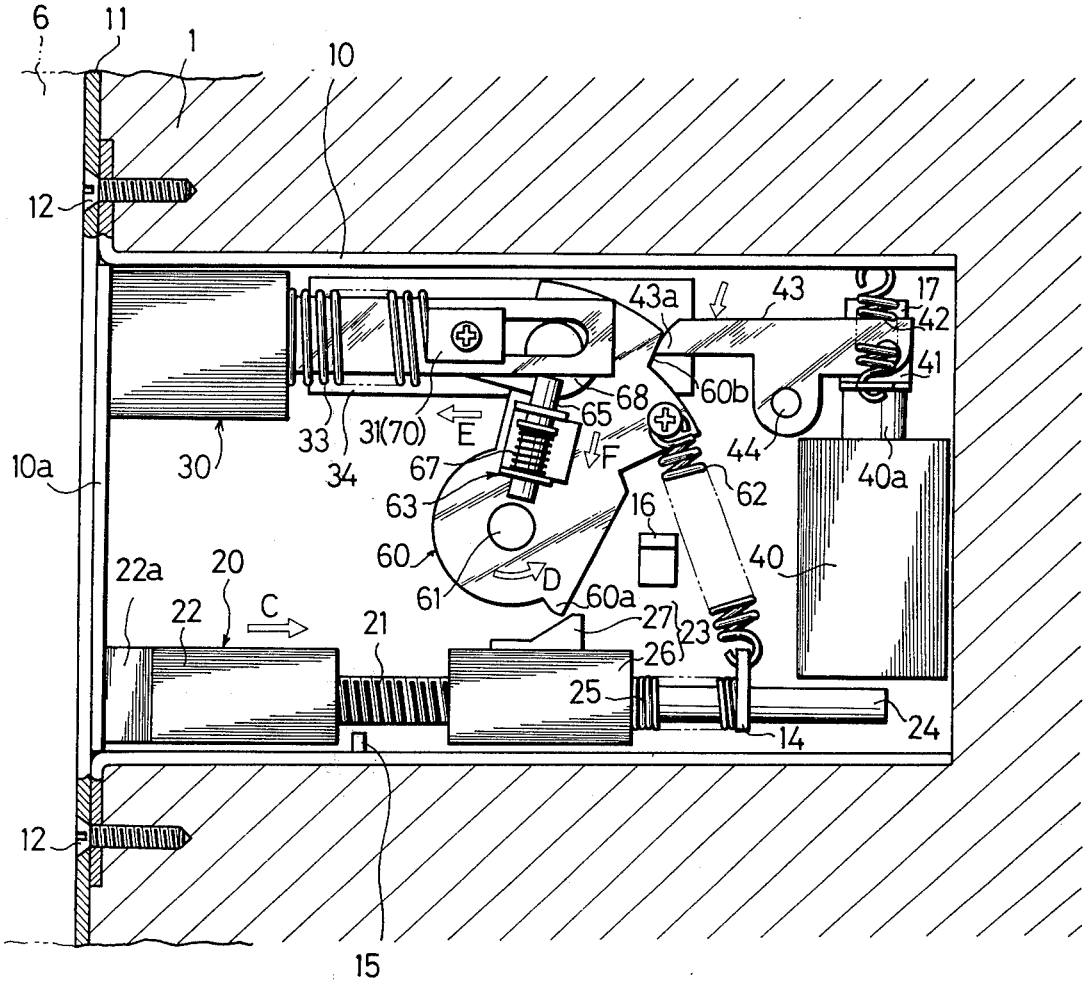

FIGS. 2, 3 and 4 respectively show the locking device embodying the present invention in its unlocking state, i.e. the state turned to off, an intermediate state and a locking state, i.e. the state turned to on. Referring to these FIGS., a lock housing 10 is embedded in a wall 1 and is tightly secured to the latter through an attaching plate 11 by means of screws 12. An actuating member 20 is mounted slidably by a front panel **10*a* of the lock housing 10 and a supporting piece 14. The supporting piece 14 preferably is a part of the side panel of the housing 10, which part has been cut and bent perpendicularly to the plane of the side panel. The actuating member 20 includes first and second cam members 22 and 23, respectively, which are connected to each other by means of a threaded rod 21, and a supporting shaft 24 fixed to the second cam member 23. A spring 25 positioned around the supporting shaft 24 and acting between the supporting piece 14 and the second cam 23 normally biases the actuating member 20 as a whole leftward, as viewed in the FIGS. A stopper element 15, which may also be a cut out and bent part of the side panel of the lock housing 10, is adapted to limit the stroke of the actuating member 20**.

Figure 5:
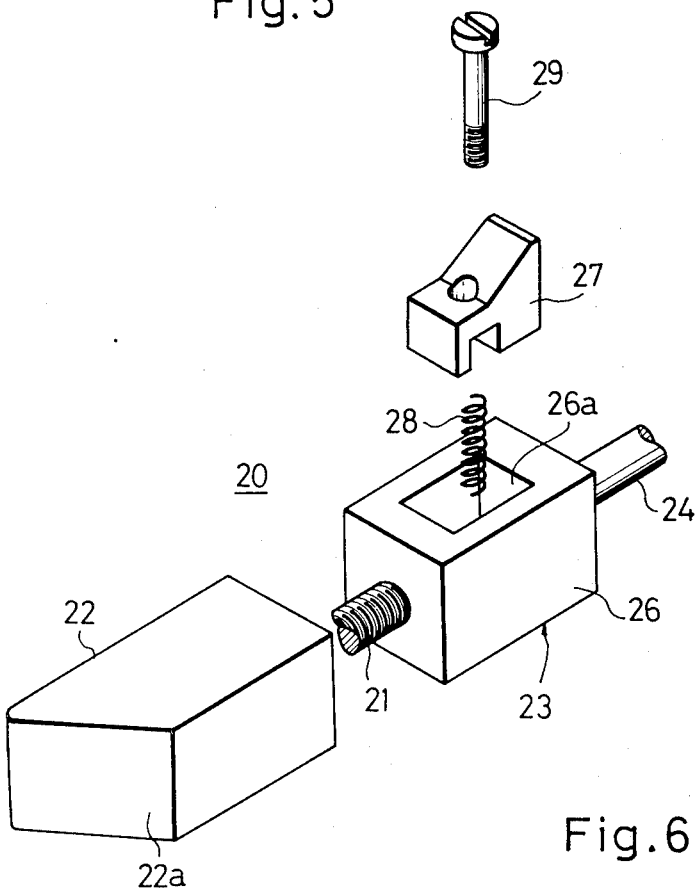
FIG. 5 is an enlarged exploded view of a portion of the actuating member incorporated in the locking device of FIG. 1.
Figure 6:
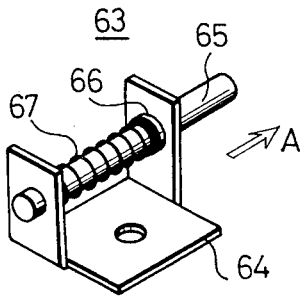
FIG. 6 is an enlarged perspective view of a portion of a stopper member incorporated in the locking device of FIG. 1.

As can be seen clearly in FIG. 5, the first cam member 22 is provided with an inclined cam surface **22*a*. Thus, as the door is closed, the inclined cam surface 22*a* of the actuating member comes to be depressed by the end surface of the door, so as to force the actuating member into the lock housing 10. Also, the distance between the first and the second cam members, i.e. the amount by which the first cam member 22 projects out of the lock housing 10, can be adjusted by screwing the rod 21 into and out of the first cam member 22**.

As can also be seen in FIG. 5, the second cam member 23 includes a carrier body 26 having a recess 26*a* and is connected between rod 21 and the supporting shaft 24. A cam body 27 is partially received within the recess 26*a*, and a coil spring 28 acts between the cam body 27 and the carrier body 26. A screw or the like 29 passes through the cam body 27 and the spring 28, and is driven into or held by the carrier body 26. Thus, the screw 29 affords an adjustment of the height of the cam body 27 on the carrier body by a predetermined amount.

The cam body 27, when moved rightward as viewed on FIG. 2, is adapted to cause a counter-clockwise, as shown in FIG. 2, rotation of a rotary cam 60, but not to cause any rotation of the rotary cam 60 during a leftward movement, due to a depression of the cam body 27 against the resilience of the spring 28 by the rotary cam 60.

The dead bolt 30 is adapted to be guided by a guideway or slot 30*a* slidably receiving a movable pin 70. Thus, the pin 70 may move in the groove by a predetermined distance. A retainer plate 31 is fastened to the top of the movable pin 70 by means of screws or the like, and is intended to abut an end of the coil spring 33 around the dead bolt 30 for holding the coil spring 33. The other end of the coil spring 33 is held by the enlarged forward portion of the bolt, as shown clearly in the FIGS.

Figure 7:
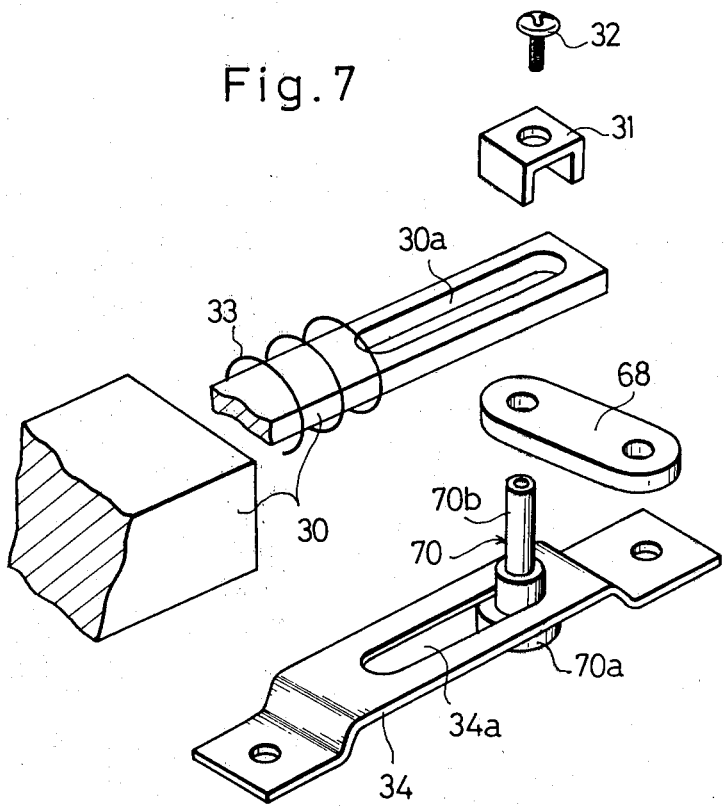
FIG. 7 is an enlarged exploded view of the movable pin and its associated members which are incorporated in the locking device of FIG. 1.

A guide member 34 is disposed behind the dead bolt 30, as viewed on FIG. 2, and is fastened at both its ends to the lock housing by means of screws or the like, as shown in FIG. 7. The guide member 34 is provided at its central portion with a guide groove 34*a* corresponding to the guideway 30*a* of the dead bolt 30. The guide groove 34*a* slidably receives the movable pin 70. A portion 70*a* of the movable pin has an enlarged diameter and is thus effective to prevent the movable pin 70 from dropping out of the groove. The journal portion 70*b* of the movable pin 70 passes through a connecting plate 68, the dead bolt 30 and then the retainer plate 31. A screw 32 screwed into the journal portion 70*b* of the movable pin 70 is effective to allow unitary movement of these members 70, 68 and 31.

Referring specifically to FIGS. 2 thru 4 and FIG. 8, an electromagnetic plunger 40 has an actuating rod 40*a* to which is fixed a generally L-shaped lever 41. A coil spring 42 is stretched between the lever 41 and the lock housing 10, so as to normally bias the actuating rod 40*a* in the direction of arrow B in FIG. 8.

Figure 8:
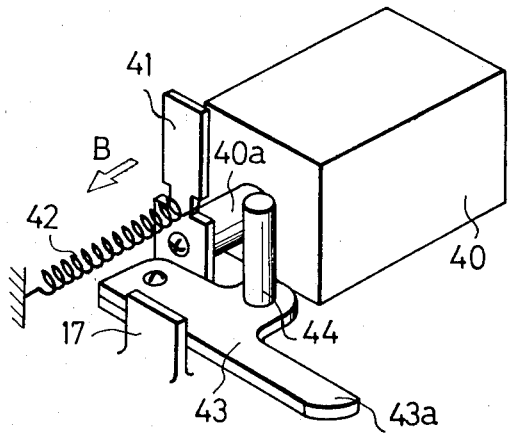
FIG. 8 is an enlarged perspective view of an electromagnetic plunger and its associated members which are also incorporated in the locking device of FIG. 1.

An end of the lever 41 is extended outwardly of the lock housing 10 to carry the aforementioned push buttom 50 (See FIG. 1), so as to afford an operation of the lever 41 from the inside of the house. An arm 43 is pivotally carried by a shaft 44 fixedly secured to the lock housing 10. The arm 43 has one end fixed to the lever 41, and the other end is in the form of a claw 43*a* for acting as a stopper to limit the rotation of the rotary cam 60. In FIG. 8, numeral 17 denotes a piece constituted by a cut out and bent part of the side panel of the lock housing 10. The piece functions as a stopper for limiting the movement of the arm 43 to a predetermined range or stroke.

In operation, referring to FIGS. 2 thru 4, the door 6 is initially open and is positioned remotely from the actuating member 20 projecting out of the lock housing 10. As the door is rotated to the closing position, it comes into contact with the inclined surface 22*a* on the first cam member 22 of the actuating member 20, so that the cam member 20 is displaced in the direction of the arrow C of FIG. 3. Consequently, the cam body 27 of the second cam member 23 is brought into contact with the cam profile 60*a* of the rotary cam 60, to cause a rotation of the cam 60 in the counter-clockwise direction, as viewed in FIG. 2, i.e. in the direction of arrow D in FIG. 3. The rotation of the rotary cam 60 in turn causes a movement of the connecting plate 68 fixed thereto, which is accompanied by movement of the pin 70. At the beginning period of this movement, the dead bolt 30 is moved along with the movable pin 70 to project slightly out of the lock housing 10. However, since the end surface of the dead bolt 30 comes into contact with the door 6, the dead bolt 30 is held against the resilient biasing force exerted by the coil spring 33. Consequently, the movable pin 70 slides within the guideway 30*a* in the direction of the arrow E of FIG. 3, compressing the coil spring 33.

The rotary cam 60 carries during its rotation a stopper member 63. Accordingly, the stopper shaft 65 on the stopper member 63 is brought into contact with the dead bolt 30 so as to be urged in the direction of arrow F of FIG. 3 against the biasing force of the coil spring 67.

As the actuating member 20 is further depressed by the door 6, the rotary cam 60 is rotated to a position where the cam body 27 of the second cam member 23 is disengaged from the cam profile 60*a* of the rotary cam 60. Then, as shown in FIG. 3, the arm 43 is dropped onto the shoulder portion 60*b* of the rotary cam 60, due to a pulling force exerted by the spring 42, so that the rotary cam 60 and the movable pin 70 are held at their respective positions shown in FIG. 3. A still further slight rotation of the door to the complete closing position brings the hole 6*a* of the door into alignment with the dead bolt 30. Consequently, the dead bolt 30 is relieved from the load applied by the door, and is allowed to extend into the hole 6*a* by the force of the coil spring 33. At the same time, the stopper shaft 65 of the stopper member 63 is extended by the force of the coil spring 67 to engage the rear end of the dead bolt 30, thereby to hold the bolt 30 at the extended position as shown in FIG. 4.

Thus, the dead bolt 30 is held at that position illustrated in FIG. 4 by the stopper member 63 engaging the rear end of the dead bolt 30, so as to ensure a safe and tight locking. It will be seen that the dead bolt 30 cannot be moved back into the lock housing by a person not having the proper means to actuate the lock. Namely, a bad-will attempt by a trespasser to force the dead bolt into the lock housing 10 by a blade or the like would be totally ineffective.

For opening the door 6 which is in the locked state as shown in FIG. 4, from the inside of the house, the aforementioned push button 3 on the control box is simply depressed. The locking device will be turned off from the outside of the house, when an identified card is inserted into the control box 2 to input a predetermined code of signal, thereby to actuate the electromagnetic plunger 40. As the electromagnetic plunger is actuated, the actuating rod 40*a* causes a clock-wise, as viewed in FIG. 4, rotation of the arm 43 against the coiled spring 42. This brings the arm 43 out of engagement with the shoulder portion 60*b* of the rotary cam 60. Consequently, the rotary cam 60 is allowed to rotate clockwise due to the pulling force of the spring 62. The dead bolt 30 which is connected to the rotary cam 60 through the connecting plate 68 and the movable pin 70 is therefore retracted into the lock housing 10. Finally, the rotary cam 60 and the dead bolt 30 resume the positions of FIG. 2, so that the door 6 is allowed to open.

As the door is opened, the actuating member is relieved from the load applied by the door, and is allowed to return from the position of FIG. 4 to the position of FIG. 2, by the force of the coil spring 25.

It will be seen that all of the parts have thus returned to the starting positions as shown in FIG. 2.

As stated before, during the returning of the actuating member 20 to the position of FIG. 2, the cam body 27 on the second cam member 23 contacts the cam profile 60*a* of the rotary cam 60 and is depressed against the compression force of the coil spring 28 since the rotary cam 60 is locked against the rotation by the stopper member 16, so as not to hinder the returning of the actuating member 20.

Also, as explained before, the manual operation of the lever 41 through a button 50 (this is provided externally of the control box) is effective to actuate the actuating lever 41 of the electromagnetic plunger 40, to turn the locking device off.

In the foregoing embodiment, the signal transmission to the electromagnetic plunger 40 is made through an operation of a control box 2 located in the vicinity of the lock housing 10. However, this signal transmission may be substituted or accompanied by a remote operation. Such a remote operation would be suitable for a centralized control of a plurality of spaced doors.

As has been described, according to the invention, the dead bolt is automatically driven out of the lock housing into the door, by the depression of an actuating member by the door, to automatically turn the locking device on. Thus, the locking device of the operation is extremely simple to operate. In addition, since no key is used, the construction is considerably simplified over conventional locking devices.

Further, since the unlocking is performed by an electromagnetic plunger adapted to be actuated by an electric signal, the unlocking operation can be conveniently controlled by a logic circuit or the like, to allow the use of a key board of a magnetic card. Also, as mentioned before, a centralized control of a plurality of remote doors can be facilitated.

At the same time, since the manually operative member connected to the actuating rod of the electromagnetic plunger is provided for operation from the outside of the lock housing, the locking device can be turned off easily to allow the opening of the door, in case of emergency, e.g. a power failure.

Having described the invention with reference to a specific preferred embodiment, it is to be noted here that various changes and modifications may be imparted thereto without departing from the scope of the invention which is defined by the appended claims.

What is claimed is:

1. A locking device for a door or the like, comprising:

(a) a housing;

(b) a bolt supported for movement between a retracted position wherein said bolt is fully within said housing and a locking position wherein said bolt is partially outside said housing;

(c) an actuating member slidably mounted within said housing, said actuating member comprising a first cam member on an end portion thereof, said first cam member extending outside said housing when said actuating member is partially outside said housing, and a second cam member within said housing;

(d) means operatively associated with said actuating member for biasing it into a position wherein said actuating member is partially outside said housing when the door is open;

(e) means operatively inter-relating said bolt and said actuating member for moving said bolt into its locking position when said actuating member is moved into a position substantially within said housing, said means inter-relating said bolt and said actuating member including a rotary cam connected at one end portion to said bolt and actuated rotatably by said second cam member when said first cam member is pressed inwardly upon a closing of the door, said actuation of said rotary cam adapted to move said bolt into its locking position.

(f) an electromagnetically actuated plunger within said housing; and (g) means operatively associated with said plunger for retracting said bolt from said locking position upon electromagnetic actuations of said plunger.

2. A locking device according to claim 1, further including a manually operative member operatively associated with said bolt retracting means and projecting outwardly from said housing whereby said bolt may be retracted from said locking position by manual manipulation of said manually operative member.

3. A locking device according to claim 2, wherein said manually operative member is connected to said plunger for manually actuation thereof.

4. A locking device according to claim 1, said first and second cam members being interconnected by a threaded rod so as to permit adjustment of the spacing therebetween.

5. A locking device according to claim 1, said second cam member having a cam body resiliently biased upwardly so as to pass beneath said rotary cam when said actuating member returns to a position partially outside said housing.

6. A locking device according to claim 1, further including an arm pivotally secured in said housing, said rotary cam having a shoulder against which one end of said arm abuts when said bolt moves into its locking position so as to hold it there, said means for retracting said bolt including means for biasing said bolt into its retracted position and a lever connected to the other end of said arm and to said plunger so as to remove said arm from said shoulder upon actuation of said plunger and permit said bolt biasing means to retract said bolt.

7. A locking device according to claim 6, said lever having a portion thereof projecting outwardly of said housing whereby said plunger may be actuated by manual manipulation of said lever portion.

8. A locking device according to claim 1, said bolt having a longitudinal guideway, and including a pin extending through said guideway and connected to said end portion of said rotary cam and resilient means for biasing said pin into the rear of said guideway whereby during actuation of said rotary cam, said pin can move within said guideway until the end of said bolt is aligned with a receiving hole, whereupon said resilient means will move said bolt into its locking position within said hole.

9. A locking device according to claim 8, further including a stopper member for abuting the rear of said bolt when said bolt is in said locking position to prevent the bolt from being forced back into said housing.

* * * * *